US011643770B2

(12) United States Patent
Meyer

(10) Patent No.: US 11,643,770 B2
(45) Date of Patent: May 9, 2023

(54) BAG AND FASTENER DESIGN

(71) Applicant: Allure InDesign LLC, Cottage Grove, WI (US)

(72) Inventor: Jennifer R. Meyer, Cottage Grove, WI (US)

(73) Assignee: Allure InDesign LLC, Cottage Grove, WI (US)

( * ) Notice: Subject to any disclaimer, the term of this patent is extended or adjusted under 35 U.S.C. 154(b) by 1231 days.

(21) Appl. No.: 16/073,703

(22) PCT Filed: Feb. 22, 2018

(86) PCT No.: PCT/US2018/019121
§ 371 (c)(1),
(2) Date: Jul. 27, 2018

(87) PCT Pub. No.: WO2018/156694
PCT Pub. Date: Aug. 30, 2018

(65) Prior Publication Data

US 2019/0382947 A1 Dec. 19, 2019

Related U.S. Application Data

(60) Provisional application No. 62/463,362, filed on Feb. 24, 2017.

(51) Int. Cl.

| | |
|---|---|
| ***B65D 30/06*** | (2006.01) |
| ***D06F 95/00*** | (2006.01) |
| ***B65D 33/28*** | (2006.01) |
| ***B65D 30/00*** | (2006.01) |

(52) U.S. Cl.
CPC ..... *D06F 95/006* (2013.01); *B65D 29/00* (2013.01); *B65D 33/28* (2013.01)

(58) Field of Classification Search
CPC .... D06F 95/006; D06F 95/002; D06F 95/004; D06F 95/005; D06F 5/008; A47G 2025/1492; A45C 13/03; B65D 29/00; B65D 29/04; B65D 31/12
USPC ..... 223/85; 206/292; 383/117
See application file for complete search history.

(56) References Cited

U.S. PATENT DOCUMENTS

| | | | | |
|---|---|---|---|---|
| 2,437,149 A * | 3/1948 | Baxter | D06F 95/004 | 383/38 |
| 7,712,641 B2 * | 5/2010 | Snyder | A47G 25/14 | 211/85.3 |
| 2012/0024727 A1 * | 2/2012 | Dragan | D06F 57/12 | 206/286 |
| 2013/0075288 A1 * | 3/2013 | Bielski | D06F 95/006 | 53/473 |

(Continued)

OTHER PUBLICATIONS

International Search Report and Written Opinion of the International Searching Authority dated May 16, 2018, for International Application No. PCT/US18/19121 filed Feb. 22, 2018.

*Primary Examiner* — Jes F Pascua
*Assistant Examiner* — Nina K Attel
(74) *Attorney, Agent, or Firm* — Boardman & Clark LLP

(57) ABSTRACT

Disclosed is a garment bag comprising: a first and second panel attached along three sides, defining a bag interior; wherein a plurality of receiving fasteners are provided in the bag interior on the first panel adjacent to a top edge. The receiving fasteners may be used to securely provide garments having hooks into the garment bag.

6 Claims, 8 Drawing Sheets

(56) References Cited

U.S. PATENT DOCUMENTS

| | | | | |
|---|---|---|---|---|
| 2014/0097214 | A1* | 4/2014 | Schreckenhofer .... | D06F 95/008<br>223/85 |
| 2017/0215616 | A1* | 8/2017 | Cunningham ..... | D06F 95/008 |

* cited by examiner

BAG AND FASTENER DESIGN

CROSS-REFERENCE TO RELATED APPLICATIONS

This application claims priority as a 371 filing of International Application No. PCT/US2018/019121 filed Feb. 22, 2018, entitled "Bag and Fastener Design," which claims priority to and benefit of United States provisional patent application No. 62/463,362 filed Feb. 24, 2017, the contents of each of which is incorporated herein by reference in its entirety.

FIELD

This invention is in the field of containers, more specifically, bags.

BACKGROUND

When washing clothing using a conventional washing machine, certain items of clothing may be separated from the remainder of the clothing to be washed. Typically, these items of clothing are delicate, can be tangled, or have some other reason to warrant special treatment. These items may be put in a separate garment bag which is then deposited in the wash with the remaining items of clothing.

Brassieres (bras) may be included in the garment bag to separate them from the remainder of the wash. These garment bags seek to prevent deformation and tangling of the bra as a result of interaction with the remainder of the clothing to be washed during the use (cycle) of a conventional washing machine.

Known garment bags have a number of disadvantages. For example, these bags may cause bras to become entangled either with themselves or other items deposited in the bag. In addition, hooks (which are typically provided on the band of a bra as part of a hook-and-eye closure) may become entangled in known bags. Known garment bags may likewise require twisting of the bra to fit within the bag. As a result, bras may be damaged or deformed. In addition, other items of clothing may be damaged or deformed, for example, when the bra becomes entangled with or hooked into other items in the bag. Another disadvantage of some known garment bags is complexity of use.

SUMMARY

The disclosed invention seeks to remedy the deficiencies noted above. Namely, the disclosed garment bag according to various embodiments seeks to allow for easy deposit of a bra into the bag while retaining the bra hooks. The disclosed invention may allow for reduction in tangling or damage from hooks to other items of clothing or to the bra itself over known garment bags.

Disclosed is a garment bag comprising: a bag body defining an internal volume; a top edge, the top edge defining an opening leading to the internal volume; a closing mechanism provided along the top edge; and a plurality of receiving fasteners provided on the bag body adjacent to the top edge. Further disclosed is a garment bag further comprising a dividing panel coupled to the bag body in the internal volume, wherein the dividing panel divides the internal volume into two chambers. Further disclosed is a garment bag further comprising wherein the plurality of receiving fasteners comprises a first plurality of receiving fasteners and a second plurality of receiving fasteners is provided in the internal volume opposite the first plurality of receiving fasteners.

Disclosed is a garment bag comprising: a first panel having a first edge, second edge, top edge, and bottom edge; a second panel having a first edge, second edge, top edge, and bottom edge; wherein the first panel and second panel are attached along the first panel first edge and second panel first edge, first panel second edge and second panel second edge, first panel bottom edge and second panel bottom edge, defining a bag interior; and wherein a plurality of receiving fasteners are provided in the bag interior on the first panel adjacent to the top edge. Further disclosed is a garment bag further comprising wherein a second plurality of receiving fasteners are provided in the bag interior on the second panel adjacent the top edge. Further disclosed is a garment bag further comprising wherein the plurality of receiving fasteners are attached to the first panel by way of a backing material. Further disclosed is a garment bag further comprising wherein the plurality of receiving fasteners u-shaped and metal. The garment bag of claim 4, wherein the top edge comprises a closing mechanism. The garment bag of claim 4, wherein a third panel is coupled to the first panel left edge and first panel right edge, the third panel dividing the bag interior into two chambers.

Disclosed is a garment bag comprising: a first panel having a left edge, right edge, top edge, and bottom edge; a second panel having a left edge, right edge, top edge, and bottom edge; wherein the first panel and second panel are attached along the first panel left edge and second panel left edge, first panel right edge and second panel right edge, first panel bottom edge and second panel bottom edge, defining a bag interior; and wherein a first plurality of receiving fasteners are provided in the bag interior on the first panel adjacent to the top edge and a second plurality of receiving fasteners are provided in the bag interior on the second panel adjacent to the top edge. Further disclosed is a garment bag comprising a third panel dividing the bag interior into two chambers. Further disclosed is a garment bag wherein the third panel is connected to the first panel left edge and second panel left edge. Further disclosed is a garment bag wherein the first plurality of receiving fasteners and second plurality of receiving fasteners are sized to accept at least one hook provided on a bra. Further disclosed is a garment bag wherein each receiving fastener of the first plurality of receiving fasteners and second plurality of receiving fasteners is u-shaped.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various examples of embodiments of the systems, devices, and methods according to this invention will be described in detail, with reference to the following figures, wherein.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

Referring now to the Figures, a garment bag 101 is shown. The garment bag 101 disclosed, in various embodiments, may reduce the ability for garments (e.g. 301) to entangle or twist with themselves or other garments during a washing cycle in a washing machine. In various embodiments, the garment bag 101 may allow for protection of hooks 303 provided on a garment 301 (for example, on a brassiere (bra)) during a washing cycle in a washing machine. Therefore, the disclosed garment bag 101 may, in various embodiments, also extend the longevity of garments.

Figure 1:
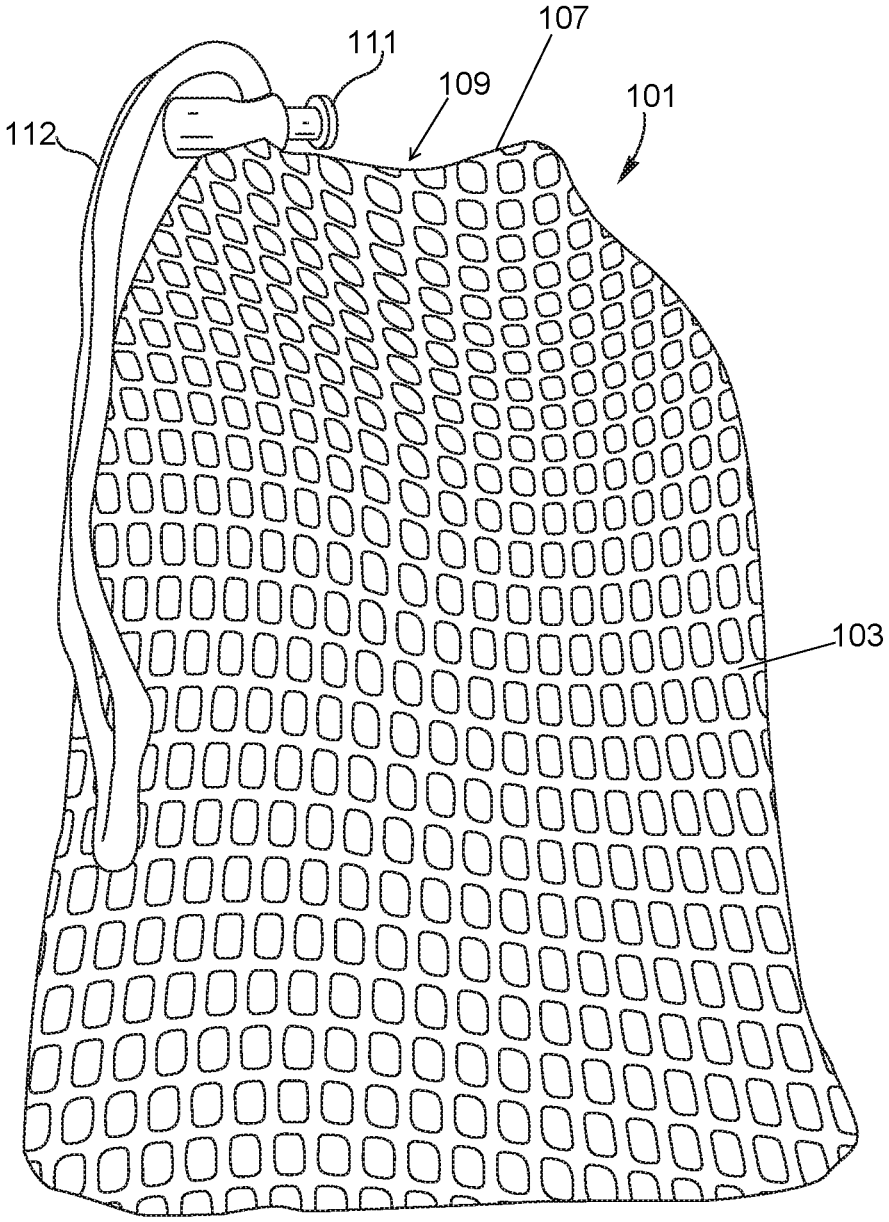
FIG. 1 shows a garment bag according to various embodiments.

In FIG. 1, a garment bag 101 according to various examples of embodiments is shown. FIG. 1 can be understood as showing an exterior of a garment bag 101, according to various examples of embodiments. The garment bag 101 may have a bag body 103 defining an internal volume 105 in various examples of embodiments. The garment bag 101 may further feature a top edge 107 defining an opening 109. The top edge 107 may further feature a closing mechanism which may comprise a drawstring 112 and a cinch fastener 111 for opening and closing the bag, in various examples of embodiments. Any suitable mechanism may be contemplated as within the scope of this disclosure, such as, but not limited to, snaps, buttons, hook-and-loop fastener, zipper, and the like. While one opening 109 is shown, more than one may be contemplated as within the scope of the invention.

In various embodiments, the garment bag 101 may be constructed of a fabric 135. The fabric 135 may be seen in FIG. 1 as a mesh fabric i.e. a knit fabric having a number of openings. The mesh-style fabric may advantageously allow for water to flow through the fabric 135 and clean the garments (e.g. garment 301) provided therein. In addition, the mesh fabric 135 may allow for a faster dry time for enabling subsequent use of the bag 101. In addition, the mesh fabric 135 may be a nylon construction, which may advantageously prevent color transfers during the wash cycle.

Figure 2:
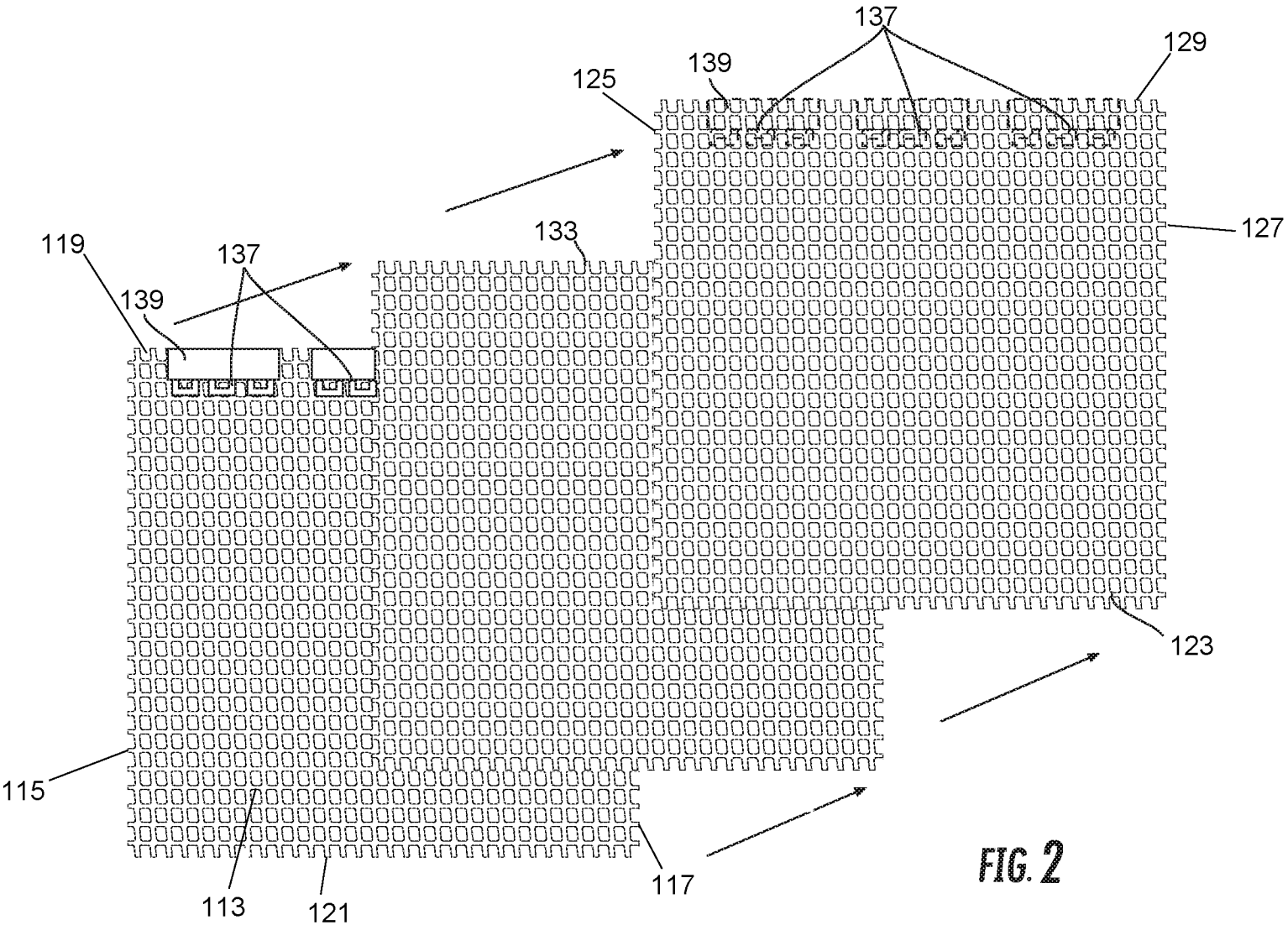
FIG. 2 shows a detail version of a garment bag, showing three panels, according to various embodiments.

FIG. 2 shows an exploded view of a garment bag 101, according to various examples of embodiments. The garment bag 101 may consist of a number of layers of fabric, which may create a number of chambers. In various embodiments, the bag may consist of a first panel 113, second panel 123, and third panel 133. The first panel may have a first edge 115, second edge 117, top edge 119, and bottom edge 121. The second panel may have a first edge 125, second edge 127, top edge 129 and bottom edge 131. The panels 113, 123, 133 may be connected (e.g. sewn together or otherwise fastened), in various embodiments, along three sides (e.g. the first panel first edge 115 and second panel first edge 125, first panel second edge 117 and 127, and first panel bottom edge 121 and second panel bottom edge 131. The panels may be understood to be connected along the length of each edge. The first panel top edge 119 and second panel top edge 129 may define an opening. While sewing or connecting the panels along the length of three edges to facilitate an opening across the length of a top edge is disclosed, for example, sewing the panels together on two sides, or on part of the fourth side (or parts of one or more sides), should be considered as within the scope of this disclosure. The third panel 133 may likewise be connected to the first panel 113 and second panel 123. In various embodiments, the third panel 133 may be connected to the first panel 113 first edge 115 and first panel second edge 117 and/or the second panel first edge 125 and second panel second edge 127. In various embodiments, the third panel 133 may span the internal volume 105 of the garment bag 101, creating two chambers 104. The third panel 133 may divide a plurality of receiving fasteners 137 provided on the first panel 113 and second panel 123.

In addition, while a rectangular or square fabric panel is shown, other shapes (triangle, quadrilateral, circle, polygon, or other shape) are within the scope of this disclosure. In various embodiments, where three layers of fabric are used, the panels may be sewn together and two chambers 104 may be created. The two chambers 104 may keep garments separate and reduce the ability to twist together. The chambers 104 may be created, in various embodiments, by connecting the three panels (for example, sewing the three panels together) on three edges, leaving a fourth edge of each panel open. Alternatively, connecting the panels (113, 123, and/or 133) in a non-edge location may be contemplated as within the scope of this disclosure. Connection in the alternate location may, in various embodiments, allow for chambers 104 of varying sizes.

In the figures, for example, FIG. 2, the first layer may have a number of receiving fasteners 137 which may comprise a number of receiving fasteners (i.e. u-shaped receiving fasteners, receiving hooks, metal loop, eye portion of hook-and-eye fastener, etc.) the second layer may have no receiving fasteners, and the third layer may have a number of other receiving fasteners. In various embodiments, the receiving fasteners 137 may be u-shaped. The receiving fasteners may be sized and shaped to accommodate a standard bra fastener. The first panel 113 and second panel 123 having receiving fasteners 137 may face inward toward the third panel 133, in various examples of embodiments. In various embodiments, the panels (113, 123, and/or 133) may allow for multiple garments having hooks to be received by receiving fasteners 137 and provided within a bag 101. More particularly, in various embodiments, the panels (113, 123, and/or 133) may allow for multiple sets of receiving fasteners 137 to be provided within each bag 101. In various embodiments, each garment bag 101 may have two panels (i.e. first panel 113 and second panel 123) having a number of sets of receiving fasteners 137 (for example, two or three sets of three receiving fasteners 137 each). In various examples of embodiments, the receiving fasteners 137 may be provided adjacent to a top edge 119 of the garment bag 101. This arrangement may allow for ease in attaching the garment 301 to the bag 101 for washing. Other arrangements (locations of the hooks, location of the opening) may be contemplated within the scope of this disclosure. For example, a third panel 133 may not be provided, and the bag 101 may be constructed of two panels (113, 123). In an alternative embodiment, more than three panels may be provided (e.g., four, five, six, etc.) which may allow for additional chambers (three, four, five, etc.) in the bag 101. In various embodiments, the panels may be sewn together and one or more closing and opening mechanisms 111 provided.

Figure 3:
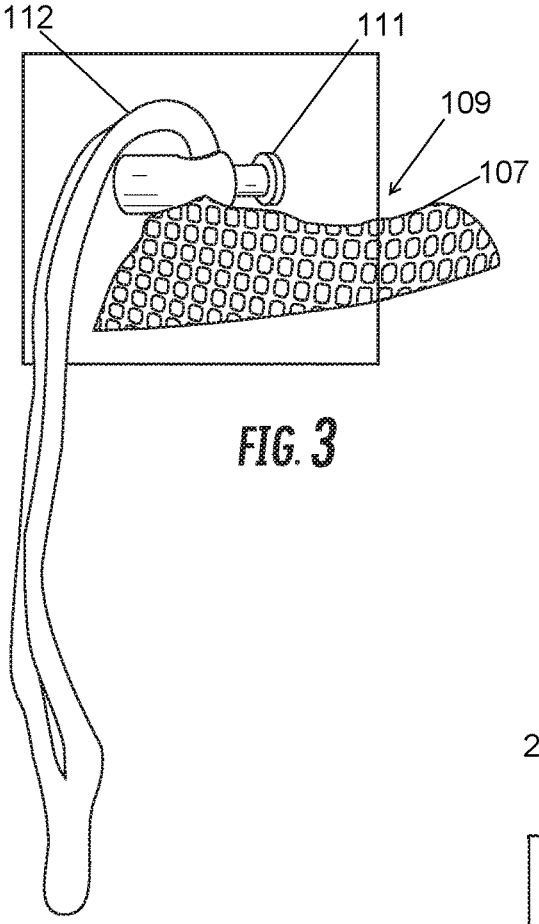
FIG. 3 shows a detail view of a garment bag, showing a closing mechanism, according to various embodiments.
Figure 4:
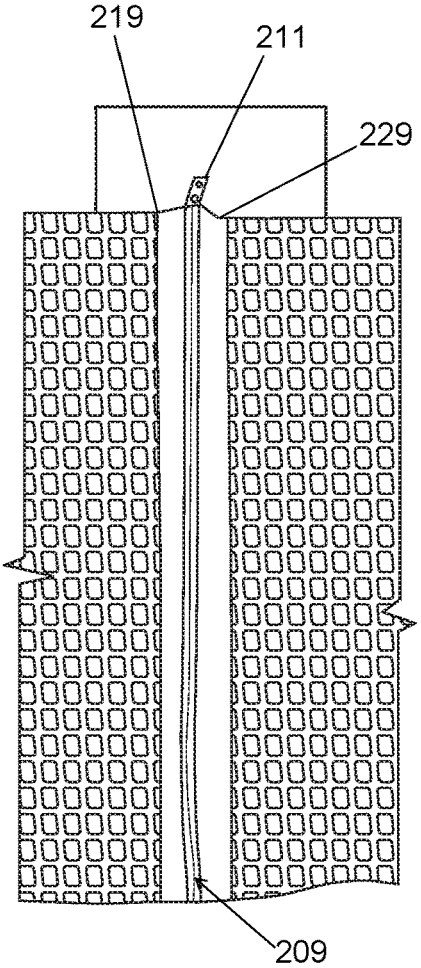
FIG. 4 shows a detail view of a garment bag, showing a closing mechanism, according to various embodiments.

FIGS. 3 and 4, various embodiments of closing and opening mechanisms 111 may be seen. FIG. 3 shows a drawstring-style 112 closing and opening mechanism 111. In various embodiments, FIG. 3 shows a detail view of a top of a bag 101, according to various embodiments. The bag 101 may be seen in FIG. 3 as in a closed state (i.e. opening 109 is substantially inaccessible). A rope or string may be provided through a top portion (i.e. top edge 107) of the bag 101, with extra length provided externally to the bag 101. A drawstring 112 and clasp (for example, a toggle spring stop style clasp) may be provided on the rope or string 112 in order to hold the bag 101 shut.

FIG. 4 shows another embodiment of the garment bag 201 having an opening and closing mechanism 221. In various embodiments, FIG. 4 may be understood as a top view of the bag 201 having a zipper 221. In various embodiments, the zipper may span a top edge of the bag. In various embodiments, the zipper 221 may span connect a first panel top edge 219 and second panel top edge 229, which when unzipped allows access to an opening 209.

FIGS. 5-8 show a number of different arrangements of receiving fasteners 137 for a garment bag 101, according to various examples of embodiments. In various embodiments, the amount of receiving fasteners 137 and number of sets of hooks (i.e. groups of receiving fasteners 137 grouped together or otherwise provided on each base 139) can vary. In various embodiments, the amount and number of sets of receiving fasteners 137 may depend on the overall size of the garment bag 101 and the overall size of the garment 301 for use with the bag 101. A number of receiving fasteners 137 may be provided on a thickened piece of fabric or base 139. This base 139 may provide a secure anchor or holder for the receiving fasteners 137. The base 139 may then be sewn or otherwise attached to the panel (113, 123, and/or 133). The receiving fasteners 137 on the base 139 may be provided on an interior face of a panel (113, 123, 133), e.g. inside/within internal volume 105 of the bag 101. The receiving fasteners 137 may be oriented such that they are accessible when reaching into the bag 101, for example, to put a garment inside (e.g. garment 301).

Figure 5:
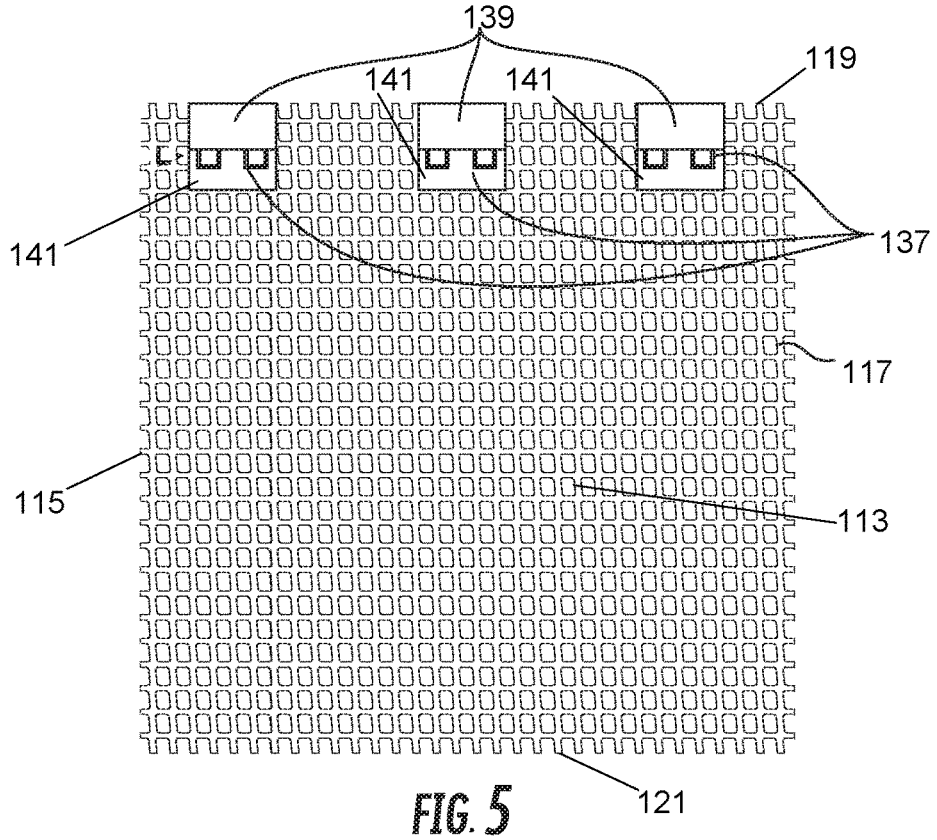
FIG. 5 shows a detail view of a garment bag according to various examples of embodiments, showing a number of receiving fasteners provided on a bag panel.

In FIG. 5, a detail view of a garment bag 101, specifically a panel 113 (while first panel 113 is specified, it should be understood the detail may likewise be applied to second panel 123 or third panel 133) is provided, according to various embodiments. Two receiving fasteners 137 may be seen provided on each base 139. In addition, a fabric backing 141 may be seen behind the receiving fasteners 137. The fabric backing 141 may be attached or sewn to the base 139. The fabric backing 141 may aid in connecting a hook provided on a garment (e.g. a bra fastener) to the receiving fastener 137 provided on the bag 101 or bag panel 113. Three groups or sets of the two receiving fasteners 137 on a base 139 are shown provided on the panel 113. The panel 113 may further comprise a first edge 115, send edge 117, top edge 119, and bottom edge 121.

Figure 6:
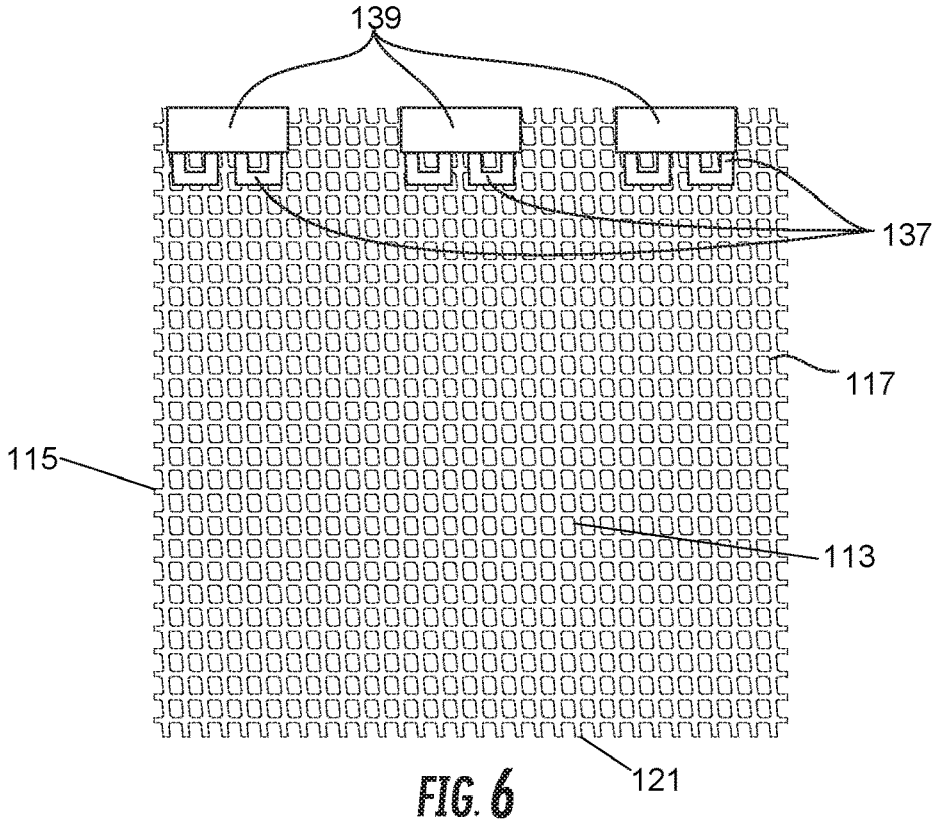
FIG. 6 shows a detail view of a garment bag according to various examples of embodiments, showing a number of receiving fasteners provided on a bag panel.

An alternative embodiment is shown in FIG. 6. In FIG. 6, a detail view of a garment bag 101, specifically a panel 113 (while first panel 113 is specified, it should be understood the detail may likewise be applied to second panel 123 or third panel 133) is provided, according to various embodiments. Two receiving fasteners 137 may be seen provided on each base 139. Three panels of the two receiving fasteners 137 on a base 139 are shown provided on the panel 113. The panel 113 may further comprise a first edge 115, send edge 117, top edge 119, and bottom edge 121. Here, the two receiving fasteners 137 are provided on a base 139 and attached to a panel 113 for provision into a bag 101. Three sets of the two receiving fasteners 137 on a base 139 are shown. The receiving fasteners 137 on the base 139 are provided without a fabric backing.

Figure 7:
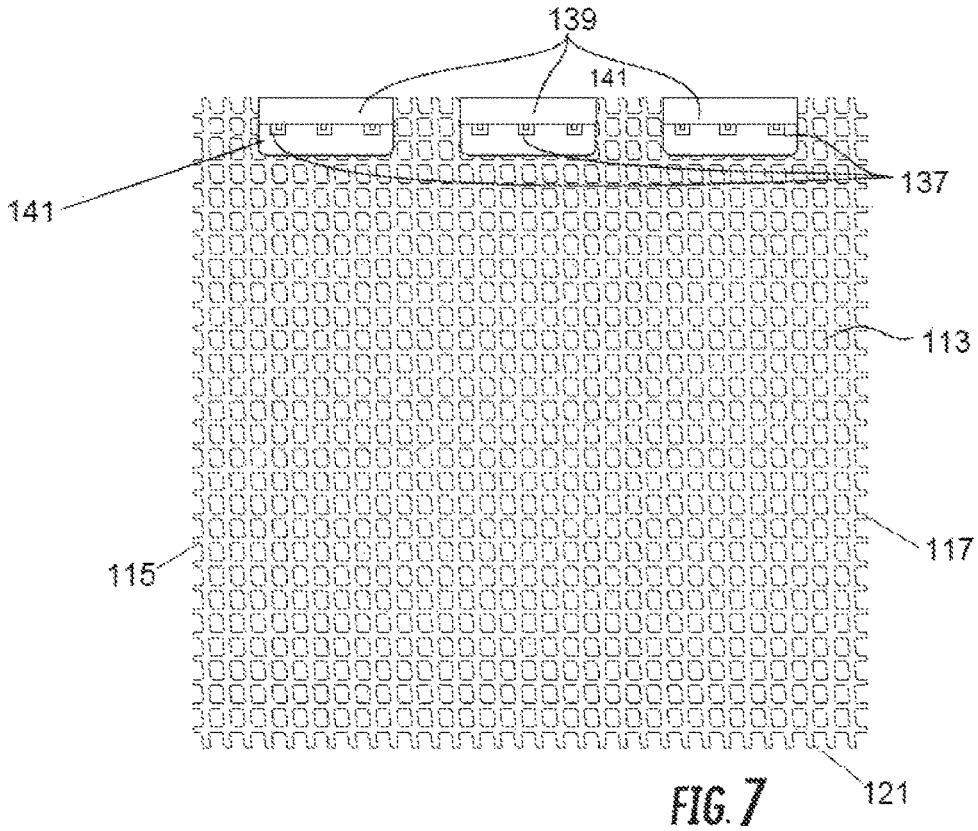
FIG. 7 shows a detail view of a garment bag, showing a number of receiving fasteners provided on a bag panel, according to various embodiments.

Another alternative embodiment may likewise be seen in FIG. 7. A detail view of a garment bag 101, specifically a panel 113 (while first panel 113 is specified, it should be understood the detail may likewise be applied to second panel 123 or third panel 133) is again provided, according to various embodiments. Here, three receiving fasteners 137 are provided on a base 139. The base 139 is attached to a bag panel 113 to be provided as part of a bag 101. Three sets of fasteners having three receiving fasteners 137 are provided on the base 139. In addition, a fabric backing 141 is provided for the three receiving fasteners 137 on each base 139. The fabric backing 141 may be seen behind the receiving fasteners 137. The fabric backing 141 may be attached or sewn to the base 139. The fabric backing 141 may aid in connecting a hook provided on a garment (e.g. a bra fastener) to the receiving fastener 137 provided on the bag 101 or bag panel 113. Three groups or sets of the three receiving fasteners 137 on a base 139 are shown provided on the panel 113. The panel 113 may further comprise a first edge 115, send edge 117, top edge 119, and bottom edge 121.

Figure 8:
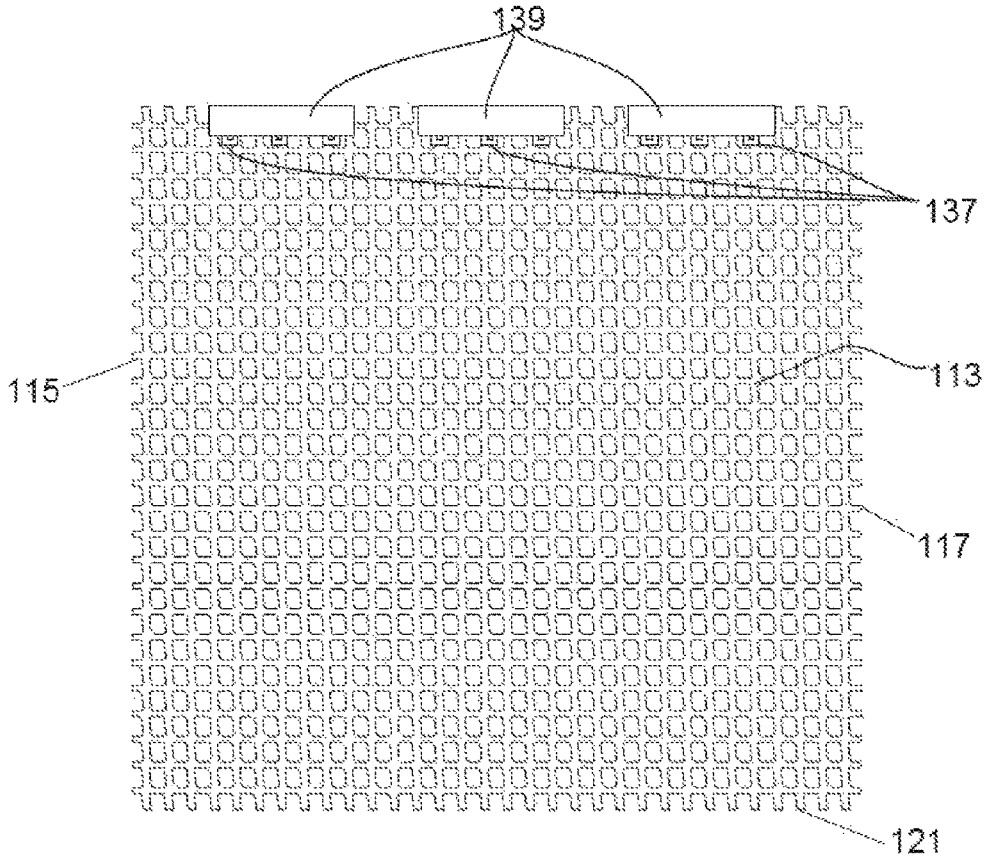
FIG. 8 shows a detail view of a garment bag, showing a number of receiving fasteners provided on a bag panel, according to various embodiments.

Yet another alternative embodiment is shown in FIG. 8. A detail view of a garment bag 101, specifically a panel 113 (while first panel 113 is specified, it should be understood the detail may likewise be applied to second panel 123 or third panel 133) is again provided, according to various embodiments. Here, three receiving fasteners 137 are provided on a base 139. The base 139 is attached to a bag panel 113 to be provided as part of a bag 101. Three sets of fasteners having three receiving fasteners 137 are provided on the base 139. No fabric backing is provided. Three groups or sets of the three receiving fasteners 137 on a base 139 are shown provided on the panel 113. The panel 113 may further comprise a first edge 115, send edge 117, top edge 119, and bottom edge 121.

In various embodiments, the receiving fastener 137, base 139, backing 141, and panel (113, 123, 131) arrangements of FIGS. 5-8 may be provided into a 1-2 chamber 104 mesh bag having rectilinear panels with a drawstring or zipper closure. Alternatively, the panels (113, 123, 131) and bag 101 may be constructed in connection with the other disclosed arrangements disclosed above. While sets of two or three receiving fasteners 137 on a base 139 may be seen in the example embodiments, more or less receiving fasteners 137 or sets on each base 139 may be understood to be contemplated as within the scope of this disclosure. For example, one receiving fastener 137 per base 139, or sets of four or more receiving fasteners per base 139 may be contemplated as within the scope of this disclosure. In addition, while three sets of bases 139 having receiving fasteners 137 may be seen, more or less bases 139 with receiving fasteners 137 should be contemplated as within the scope of this disclosure. For example, one base 139 with many receiving fasteners 137, or many bases 139 with few receiving fasteners 137, or variations thereof (e.g., one base with more than three receiving fasteners 137 provided on a panel (113, 123, 133) with another base 139 with less than three receiving fasteners 137 on the same panel) should be understood as within the scope of this disclosure. Variations on the spacing of the hooks should likewise be contemplated as within the scope of this disclosure. Closer or further spacing of the hooks relative to each other or varied spacing thereof is contemplated as within the scope of this disclosure.

Figure 9:
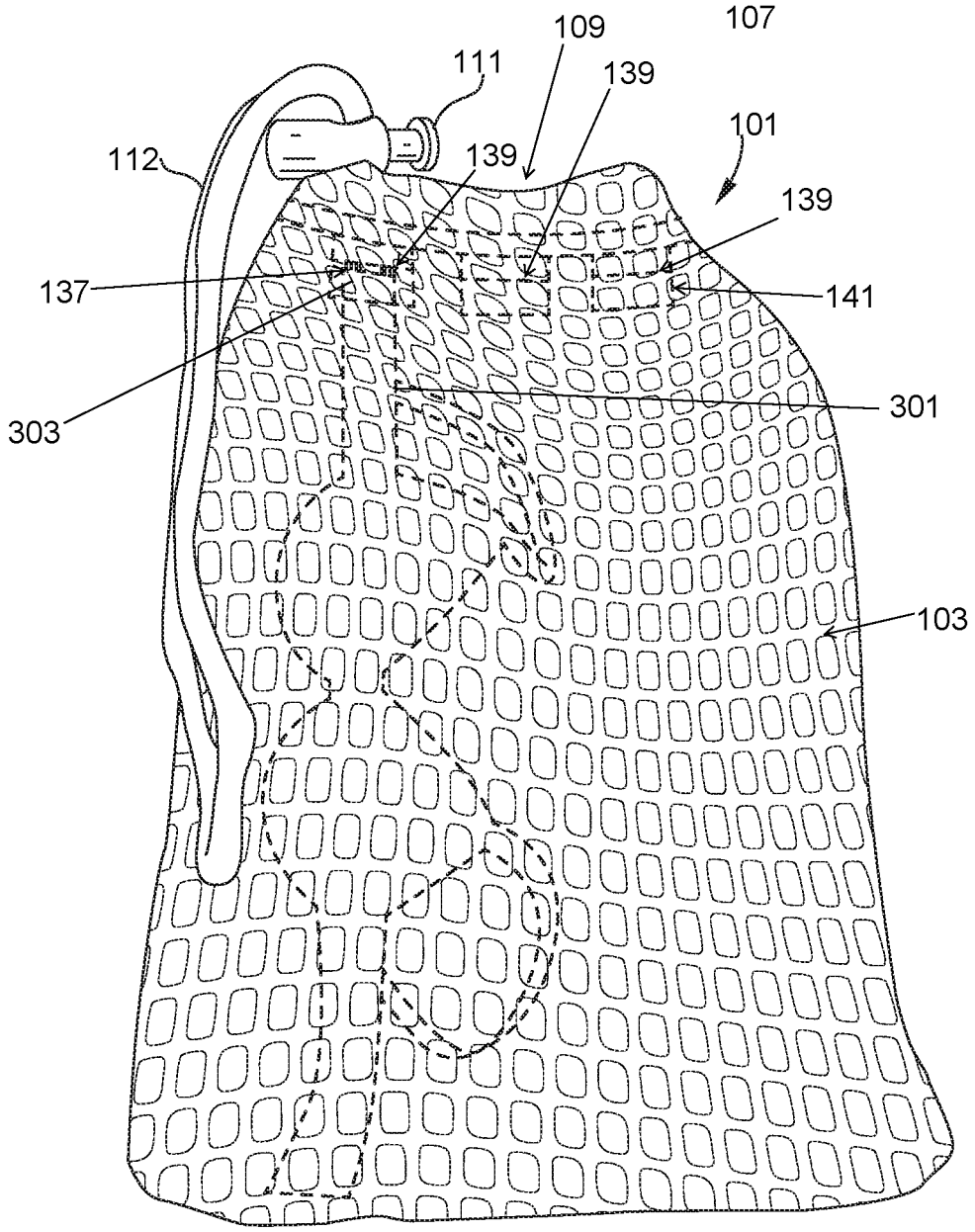
FIG. 9 shows an article of clothing provided within a garment bag, according to various embodiments.
Figure 10:
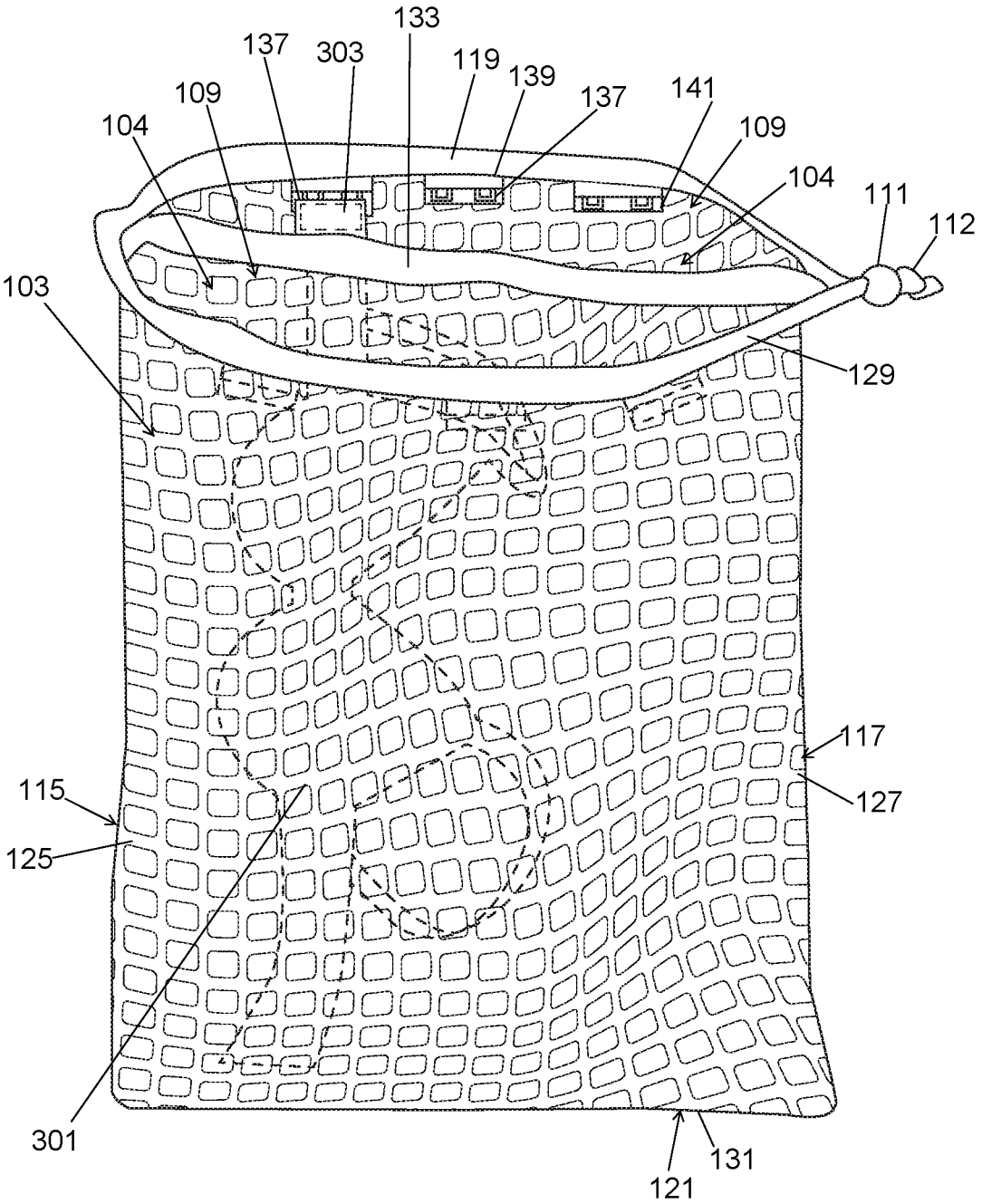
FIG. 10 shows a detail view of a garment attached to the garment bag, according to various embodiments.
Figure 11:
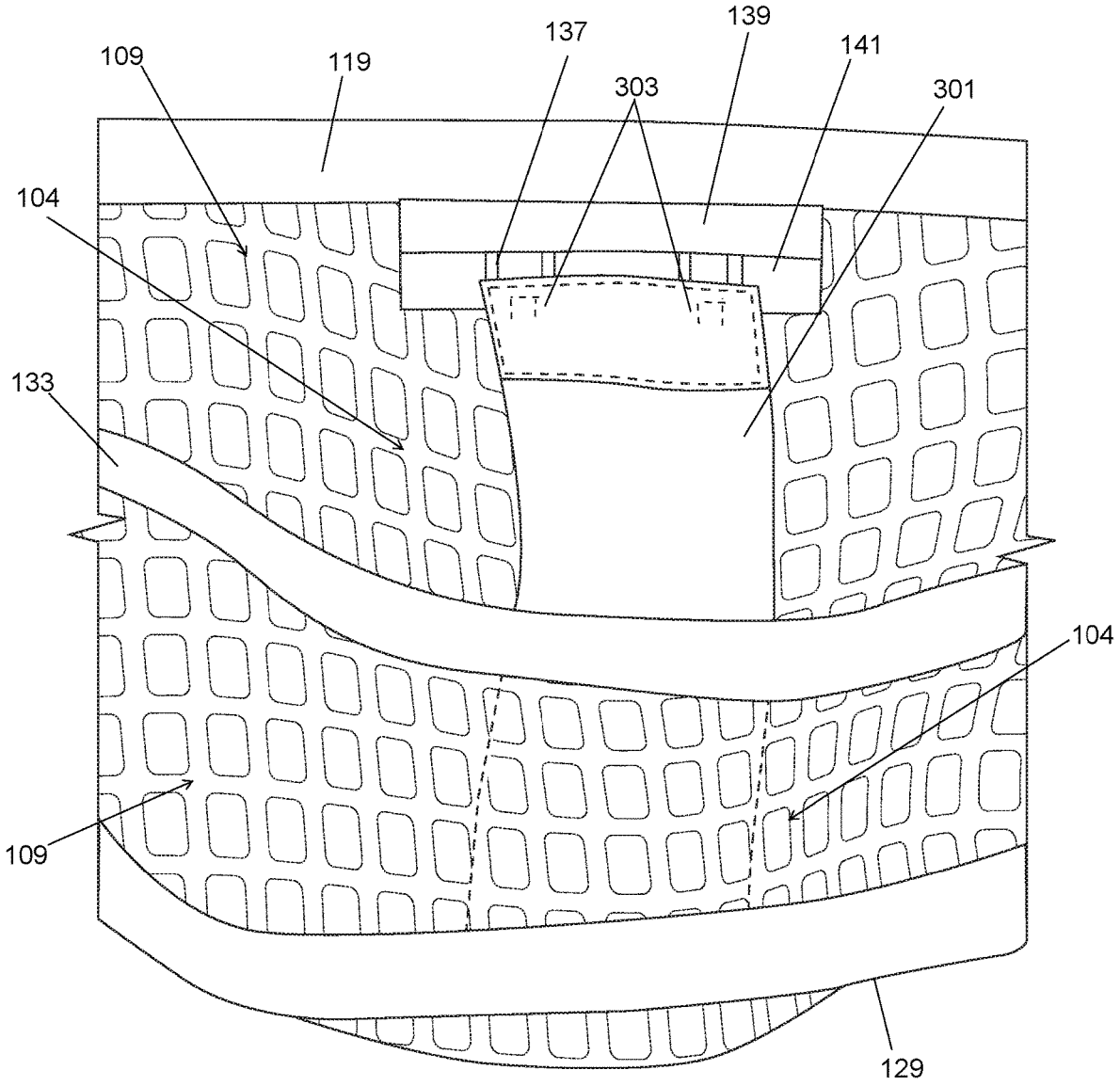
FIG. 11 shows a second view of an article of clothing provided within a garment bag, according to various embodiments.

FIGS. 9-11 show examples of a garment provided within a bag, according to various examples of embodiments.

FIG. 9 shows a closed garment bag 101 having a cinch fastener 111 with a drawstring 112. The closing mechanism is provided along a top edge 107 of the bag 101 to allow access to an opening 109 leading to an internal volume 105 of the bag body 103. The bag 101 is comprised of a mesh fabric. A number of receiving hooks 137 is provided on the bag body 103 by way of a number of bases 139. The receiving fasteners 137 and bases 139 can be seen inside the bag 101. Attached to the receiving fasteners 137 is a garment 301, specifically a bra, having a number of fastening hooks 303 attached to the receiving fasteners 137.

FIG. 10 shows a second view of the bag 101 of FIG. 9, according to various examples of embodiments. Here, the bag 101 can be seen in an open position, the closing mechanism 111 and drawstring 112 opened showing access to the internal volume 105 of the bag body 103 by way of the opening 109 which is defined by the first panel top edge 119, second panel top edge 129 and third panel 133. a number of fasteners 137 may be seen adjacent to the first panel top edge 119. The plurality of fasteners 137 may be attached to the first panel by way of a base 139. The receiving fasteners 137 may likewise comprise a backing fabric 141. The receiving fasteners may be seen attached to a garment 301 by way of garment hooks 303 provided on the garment 301. The bag 101 may be divided into two chambers 104 by a third panel 133. The bag may be defined by the first and second panels joined along a first panel first edge 115 and second panel first edge 125, a first panel second edge 117 and second panel second edge 127, and a first panel bottom edge 121 and second panel bottom edge 131. Further receiving fasteners 137 may be seen on the second panel.

A detail view of FIG. 10 may be seen in FIG. 11. Again, two openings 109 can be seen defined by a second panel top edge 129, first panel top edge 119 and third panel 133. Receiving fasteners 137 are shown provided on a base 139 having a backing 141. A garment 301 having hooks 303 may be seen attached to the receiving hooks 137 by hooking through the u-shaped receiving fastener 137.

In use, a brassiere (bra) or other garment 301 having hooks 303 may be hooked into a receiving fastener 137 (hooks) provided on the garment bag 101 (or bag panels 113, 123, 133). Then the remainder of the garment 301 may be provided into the bag 101 openings 109 and inserted into the bag body 103. Additional garments may likewise be added to the bag 101. Finally, the bag may be closed using the closing mechanism 111 (for example by tightening the drawstring 112 or zipping the zipper 211) and added into a standard washing machine for cleaning of the garments.

Hooking the garment to the bag, in various embodiments, may help keep the garment from being caught on other pieces of laundry (garments) and from snagging or tearing the garment and other pieces of laundry. In addition, hooking the garment to the bag, in various embodiments, may prevent bending of the garment hook. In addition, the garment bag, in various embodiments, may have multiple chambers 104. The provision of multiple chambers 104 may further protect garments from twisting or entangling with other garments within or external to the bag during the washing process.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom" or "left" and "right") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

The invention claimed is:

1. A washing machine washable garment bag for protection from a set of hooks provided on a brassiere during a washing cycle, the garment bag comprising:

a bag body defining an internal volume and comprising an open mesh-style fabric to allow for water to flow through the fabric and clean the garment when washed in the washing machine;

a top edge defining an opening leading to the internal volume;

a closing mechanism provided along the top edge; and a plurality of receiving fasteners provided on the bag body near the top edge, the plurality of receiving fasteners being disposed in the internal volume of the bag body, and being spaced and sized to accept the set of hooks provided on the brassiere.

2. The garment bag of claim 1, wherein each receiving fastener of the plurality of receiving fasteners is u-shaped.

3. The garment bag of claim 1, wherein each receiving fastener of the plurality of receiving fasteners is an eye of a hook and eye fastener.

4. The garment bag of claim 1, wherein the mesh-style fabric is nylon.

5. The garment bag of claim 1, comprising a base provided on the bag body near the top edge, wherein the plurality of receiving fasteners is supported by the base.

6. The garment bag of claim 5, comprising a fabric backing provided on the bag body adjacent to the top edge, wherein the base and the plurality of receiving fasteners are provided on the fabric backing.

* * * * *